US008816667B2

(12) United States Patent
Lee

(10) Patent No.: US 8,816,667 B2
(45) Date of Patent: Aug. 26, 2014

(54) MAXIMUM POWER POINT TRACKING METHOD

(75) Inventor: Ki su Lee, Anyang-si (KR)

(73) Assignee: LS Industrial Systems Co., Ltd., Anyang-Si, Gyeonggi-Do (KR)

( * ) Notice: Subject to any disclaimer, the term of this patent is extended or adjusted under 35 U.S.C. 154(b) by 141 days.

(21) Appl. No.: 13/522,697

(22) PCT Filed: Jan. 18, 2011

(86) PCT No.: PCT/KR2011/000356
§ 371 (c)(1),
(2), (4) Date: Jul. 17, 2012

(87) PCT Pub. No.: WO2011/087342
PCT Pub. Date: Jul. 21, 2011

(65) Prior Publication Data

US 2013/0063117 A1 Mar. 14, 2013

(30) Foreign Application Priority Data

Jan. 18, 2010 (KR) ..... 10-2010-0004349

(51) Int. Cl.
*G05F 5/00* (2006.01)
*G05F 1/67* (2006.01)

(52) U.S. Cl.
CPC ..... *G05F 1/67* (2013.01); *Y10S 323/906* (2013.01)
USPC ..... 323/299; 323/906

(58) Field of Classification Search
USPC ..... 363/15, 16, 17, 18, 19, 20, 21, 97, 131; 323/299, 906
See application file for complete search history.

(56) References Cited

U.S. PATENT DOCUMENTS

| | | | | |
|---|---|---|---|---|
| 8,461,798 | B2 * | 6/2013 | Heo et al. | 320/101 |
| 8,611,117 | B2 * | 12/2013 | Kim et al. | 363/95 |
| 2008/0203994 | A1 | 8/2008 | Park | |
| 2012/0062202 | A1 * | 3/2012 | Min | 323/299 |

FOREIGN PATENT DOCUMENTS

| | | |
|---|---|---|
| CN | 2919127 | 7/2007 |
| CN | 101599724 | 12/2009 |
| JP | 06083465 | 3/1994 |
| JP | 08-147054 | 6/1996 |
| JP | 10-207560 | 8/1998 |

(Continued)

OTHER PUBLICATIONS

Japan Patent Office Application Serial No. 2012-549926, Office Action dated Oct. 15, 2013, 3 pages.

(Continued)

*Primary Examiner* — Gary L Laxton
*Assistant Examiner* — Afework Demisse
(74) *Attorney, Agent, or Firm* — Lee, Hong, Degerman, Kang & Waimey

(57) ABSTRACT

A maximum power point tracking method is provided. The method includes temporarily determining a next voltage command using voltage and power measured at current and previous time points. When an increase or decrease in voltage command is continued predetermined times or more, it is decided that the next voltage command temporarily determined to be increased is decreased or that the next voltage command temporarily determined to be decreased is increased. The output voltage of a solar cell is regulated based on the decided next voltage command.

5 Claims, 6 Drawing Sheets

(56) References Cited

FOREIGN PATENT DOCUMENTS

| | | |
|---|---|---|
| JP | 2002-271991 | 9/2002 |
| JP | 2005-235082 | 9/2005 |
| KR | 10-0164530 | 3/1999 |
| KR | 10-0757320 | 9/2007 |
| KR | 10-0763135 | 10/2007 |

OTHER PUBLICATIONS

The State Intellectual Property Office of the People's Republic of China Application Serial No. 201180006445.5, Office Action dated Nov. 22, 2013, 5 pages.
Japan Patent Office Application Serial No. 2012-549926, Office Action dated Apr. 9, 2014, 3 pages.

* cited by examiner

MAXIMUM POWER POINT TRACKING METHOD

CROSS-REFERENCE TO RELATED APPLICATIONS

This application is the National Stage filing under 35 U.S.C. 371 of International Application No. PCT/KR2011/000356, filed on Jan. 18, 2011, which claims the benefit of earlier filing date and right of priority to Korean Application No. 10-2010-0004349, filed on Jan. 18, 2010, the contents of which are all hereby incorporated by reference herein in their entirety.

TECHNICAL FIELD

The present invention relates to a maximum power point tracking (MPPT) method in photovoltaic generation, and more particularly, to an MPPT method that can be performed in a grid connected inverter of a photovoltaic generation system.

BACKGROUND

Control algorithms required in a grid connected photovoltaic generation system may be largely divided into a maximum power point tracking (MPPT) control algorithm, a DC-DC converter input current control algorithm, a phase locked loop (PLL) control algorithm, a DC link voltage control algorithm, an inverter output current control algorithm, an anti-islanding algorithm and an islanding protection algorithm.

Since power of photovoltaic energy is nonlinearly changed depending on amount and temperature of solar radiation, the MPPT control algorithm is a control method of maximizing efficiency by detecting a maximum power point. The DC-DC converter input current control algorithm is performed using input reference current of a DC-DC converter, generated through the MPPT control algorithm. The PLL control algorithm is used to detect phases of a grid connected voltage and to generate output reference current of an inverter. The DC link voltage control algorithm is used to control a DC link current of the inverter to be constant, and generate amplitude of inverter output reference current. The inverter output current control algorithm is performed by generating inverter output reference current according to the phase and amplitude of a DC link voltage generated through the PLL control algorithm and the DC current voltage control algorithm.

Among these control algorithms, the MPPT control algorithm is performed prior to other control algorithms, and therefore requires rapidity and accuracy.

DISCLOSURE

Technical Problem

The present invention provides a rapid and accurate maximum power point tracking (MPPT) for a photovoltaic generation system.

Particularly, the present invention provides an MPPT that can reflect a change in the amount of solar radiation.

Technical Solution

According to an aspect of the present invention, there is provided a maximum power point tracking method. The method comprises temporarily determining a next voltage command using voltage and power measured at current and previous time points; deciding that the next voltage command temporarily determined to be increased is decreased or that the next voltage command temporarily determined to be decreased is increased, when an increase or decrease in voltage command is continued predetermined times or more; and regulating the output voltage of a solar cell based on the decided next voltage command.

According to another aspect of the present invention there is provided a solar cell system. The system comprises a solar cell panel; a measurement unit configured to measuring an electrical characteristic of power generated in the solar cell panel; a DC-DC converter configured to perform DC-DC conversion on the power generated in the solar cell panel; and a control unit configured to temporarily determine a next voltage command using voltage and power measured at current and previous time points, decide that the next voltage command temporarily determined to be increased is decreased or that the next voltage command temporarily determined to be decreased is increased when an increase or decrease in voltage command is continued predetermined times or more, and regulate the output voltage of the solar cell panel based on the decided next voltage command, thereby performing an MPPT method for power generated in the solar cell panel.

Advantageous Effects

According to the MPPT method of the present invention configured as described above, a change in the amount of solar radiation can be rapidly and accurately reflected in a photovoltaic generation system.

BEST MODE

The present invention is described more fully hereinafter with reference to the accompanying drawings, in which embodiments of the present invention are shown. This present invention may, however, be embodied in many different forms and should not be construed as limited to the embodiments set forth herein. Rather, these embodiments are provided so that this disclosure is thorough, and will fully convey the scope of the present invention to those skilled in the art.

The present invention is an invention in which the perturbation and observation (P&O) maximum power point tracking (MPPT) technique is additionally improved to avoid a case where a false maximum power point is tracked when the amount of solar radiation is changed.

Figure 1:
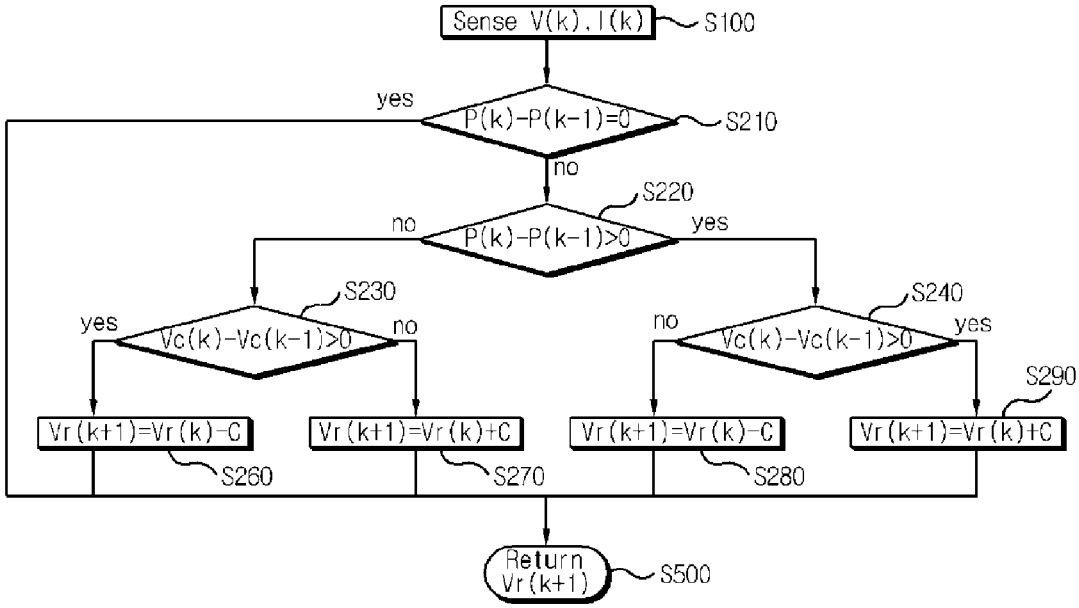
FIG. 1 is a flowchart illustrating a perturbation and observation (P&O) maximum power point tracking (MPPT) method.

FIG. 1 illustrates a representative MPPT method called as a P&O MPPT method. First, the voltage and power of a solar cell are measured at a predetermined time interval. The power is generally calculated from the measured value of voltage and the measured value of current, but will be called as power measurement for convenience of illustration.

As shown in FIG. 1, to determine a voltage command Vr(k+1) at a next measurement time point (k+1), the P&O MPPT method includes comparing current power P(k) with previous power P(k−1) (S210); comparing current voltage Vc(k) with previous voltage Vc(k−1) (S220); determining the next voltage command Vr(k+1) as a value obtained by increasing a current command Vr(k), when the current power P(k) is greater than the previous power P(k−1) and the current voltage Vc(k) is greater than the previous voltage Vc(k−1) (S290); determining the next voltage command Vr(k+1) as a value obtained by decreasing the current voltage command Vr(k), when the current power P(k) is greater than the previous power P(k−1) and the previous voltage Vc(k−1) is greater than the current voltage Vc(k) (S280); determining the next voltage command Vr(k+1) as a value obtained by decreasing the current voltage command Vr(k), when the previous power P(k−1) is greater than the current power P(k) and the current voltage Vc(k) is greater than the previous voltage Vc(k−1) (S260); and determining the next voltage command Vr(k+1) as a value obtained by increasing the current voltage command Vr(k), when the previous power P(k−1) is greater than the current power P(k) and the previous voltage Vc(k−1) is greater than the current voltage Vc(k) (S270).

If the power P(k−1) measured at a previous time point (k−1) and the power P(k) measured at a current time point k are not changed, the voltage command of the solar cell is maintained as it is (S210 and S500). On the other hand, if the power P(k−1) measured at the previous time point (k−1) and the power P(k) measured at the current time point k are changed, it is determined whether the power P(k) measured at the current time point k is increased or deceased as compared with the power P(k−1) measured at the previous time point (k−1) (S220). Also, it is determined whether the current voltage V(k) of the solar cell is increased or decreased as compared with the previous voltage V(k−1) of the solar (S230 and S240).

If the measured voltage and power are increased, the voltage command of the solar cell is increased by a predetermined value (S290). Alternatively, if the measured power is increased but the measured voltage is decreased, the voltage command of the solar cell is decreased by the predetermined value (S280). If the measured power and voltage are decreased, the voltage command of the solar cell is increased by the predetermined value (S270). If the measured power is decreased but the measured voltage is increased, the voltage command of the solar cell is decreased by the predetermined value (S260).

Figure 2:
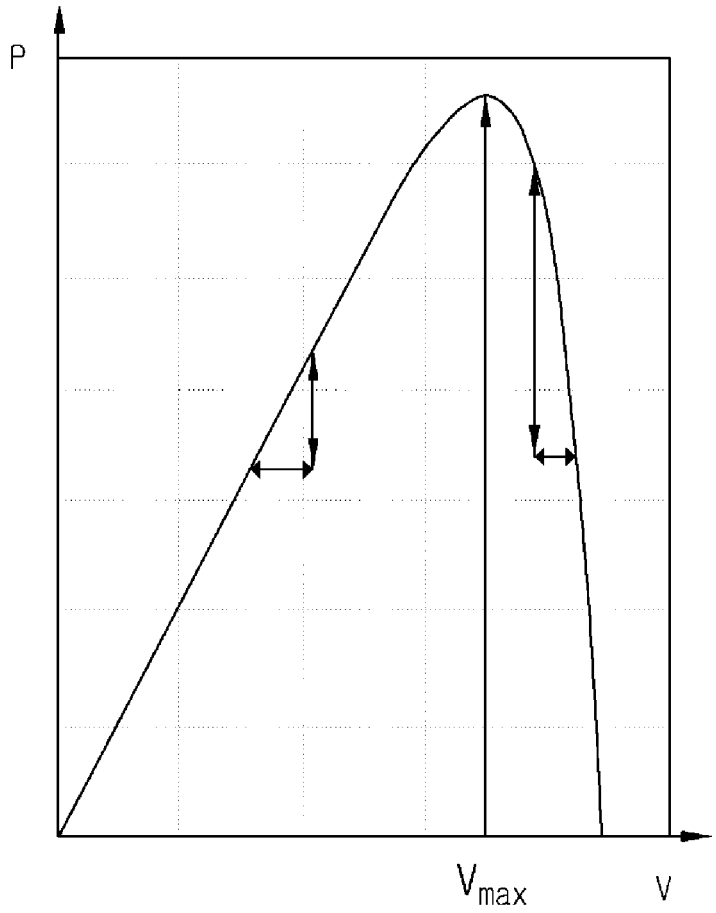
FIG. 2 is a graph illustrating an MPPT principle in a normal situation using the MPPT method of FIG. 1.

FIG. 2 illustrates a power-voltage (PV) characteristic curve of a solar cell. When the amount of solar radiation is constant, the solar cell is operated under the PV characteristic curve.

In the MPPT method of FIG. 1, the voltage and current of the solar cell are first measured at the predetermined time interval, and the power of the solar cell is then calculated. If the previous power and the current power are not changed, the voltage command of the solar cell is maintained as it is.

If the previous power and the current power are changed, it is determined whether the current power is increased or decreased as compared with the previous power, and it is determined whether the current voltage of the solar cell is increased or decreased as compared with the previous voltage of the solar cell. If the power and the voltage are increased, the voltage command of the solar cell is increased by the predetermined value. Alternatively, if the power is increased but the voltage is decreased, the voltage command of the solar cell is decreased by the predetermined value. If the power and voltage are decreased, the voltage command of the solar cell is increased by the predetermined value. If the power is decreased but the voltage is increased, the voltage command of the solar cell is decreased by the predetermined value. The maximum power point is tracked by operating a grid connected inverter according to the voltage command of the solar cell, determined as described above.

In a case where the amount of solar radiation is constant, the MPPT method shown in FIG. 1 is the simplest and most efficient method of tracking the maximum power point. However, actually, the amount of solar radiation is continuously changed depending on weather, and the maximum power point cannot be tracked or it takes long to track the maximum power point under a specific condition. Particularly, on a day on which the change in weather is serious, when the amount of solar radiation is decreased and then increased and when the voltage command of the solar cell is decreased by the predetermined value, the current voltage of the solar cell is decreased as compared with the previous voltage of the solar cell, but the amount of solar radiation is increased. Therefore, the power of the solar cell is increased, and accordingly, the voltage command of the solar cell must actually be increased. However, the voltage command of the solar cell is decreased, and the power of the solar cell is increased as the amount of solar radiation is increased. Therefore, the voltage command of the solar cell is continuously decreased, and accordingly, the maximum power point is moved opposite to the actual maximum power point. It will be apparent that in a case where such a problem is prevented by setting maximum and minimum values of voltage commands, the MPPT control may be reset. However, a fluctuation occurs in the MPPT.

Figure 3:
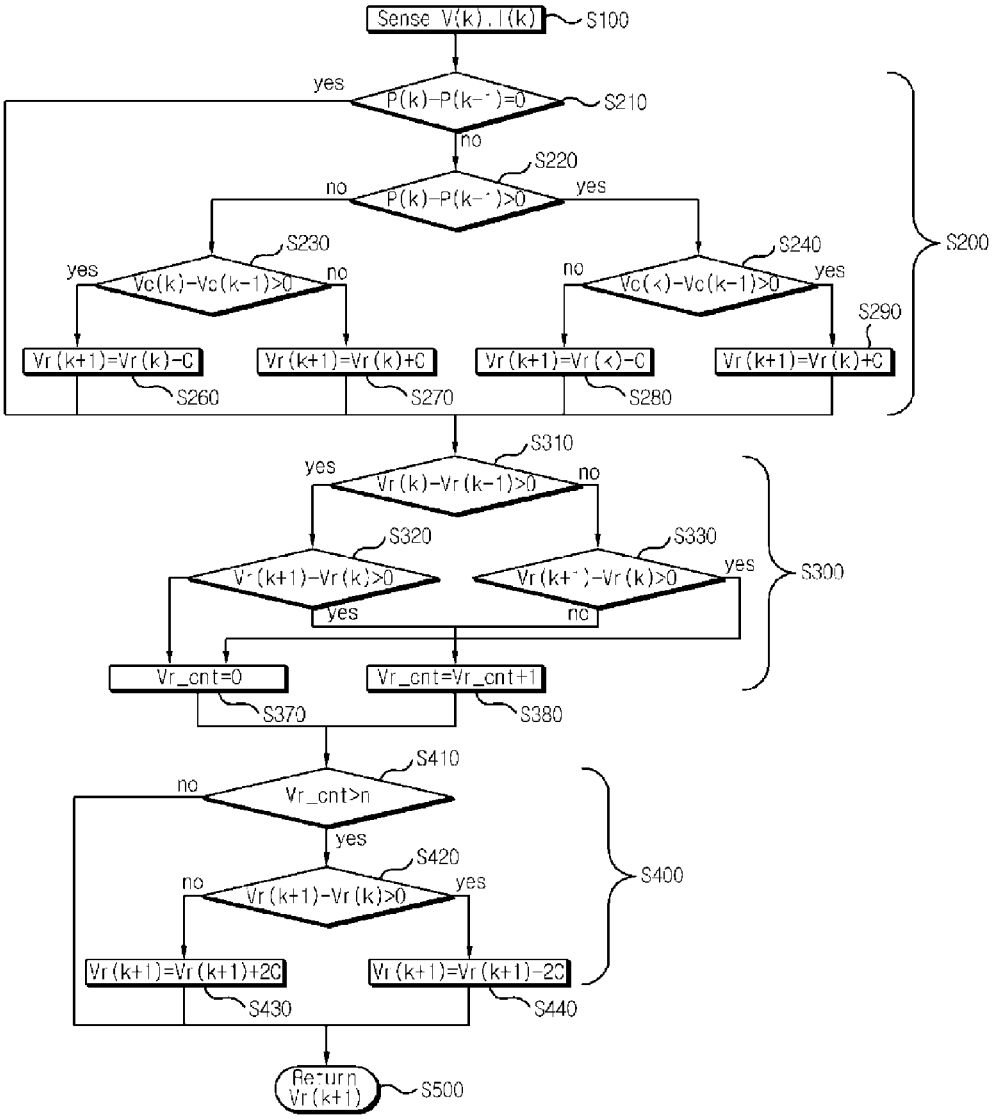
FIG. 3 is a flowchart illustrating an MPPT method according to an embodiment of the present invention.

FIG. 3 illustrates an improved MPPT method proposed in the prevent invention.

The MPPT method shown in FIG. 3 comprises temporarily determining the next voltage command Vr(k+1) using the voltage and power measured (S100) at the current measurement time point k and the previous measurement time point (k−1) (S200); identifying the number of times when an increase or decrease of the voltage command Vr is continued (S300); deciding that the next voltage command Vr(k+1) temporarily determined to be increased is decreased or deciding that the next voltage command Vr(k+1) temporarily determined to be decreased is increased, when the increase or decrease of the voltage command Vr is continued predetermined times or more (S400); and regulating the output voltage of a photovoltaic generation module based on the determined next voltage command (S500).

The steps S100 and S200 are the same as those in the P&O MPPT method of FIG. 1. However, in FIG. 3, the next voltage command of the solar cell is temporarily determined at the step S200. If the next voltage command Vr(k+1) of the solar cell is determined at one of the steps S260 to S290, an increase/decrease in the voltage command Vr(k+1) is detected at the steps S300 and S400.

That is, at the step S300, it is determined whether the voltage command between the current time point k and the next time point (k+1) is increased or decreased, and if it is determined that the voltage command Vr of the solar cell has been continuously increased or decreased, the voltage command counter Vr_cnt of the solar cell is increased. On the other hand, if it is determined that the voltage command Vr of the solar cell has not been continuously increased or decreased, the voltage command counter Vr_cnt of the solar cell is initialized as 0.

Specifically, the step S300 may comprise comparing a voltage command Vr(k−1) of the solar cell at the previous time point (k−1) with a voltage command Vr(k) of the solar cell at the current time point k (S310); comparing the current voltage command Vr(k) with a next voltage command Vr(k+1) at the next time point (k+1) (S320 and S330); the voltage command counter Vr_cnt of the solar cell is increased, when the current voltage command Vr(k) is greater than the previous voltage command Vr(k−1) and the next voltage command Vr(k+1) is greater than the current voltage command Vr(k) (S380); the voltage command counter Vr_cnt of the solar cell is reset to 0, when the current voltage command Vr(k) is greater than the previous voltage command Vr(k−1) and the current voltage command Vr(k) is greater than the next voltage command Vr(k+1) (S370); the voltage command counter Vr_cnt of the solar cell is increased, when the previous voltage command Vr(k−1) is greater than the current voltage command Vr(k) and the current voltage command Vr(k) is greater than the next voltage command Vr(k+1) (S380); and the voltage command counter Vr_cnt of the solar cell is reset to 0, when the previous voltage command Vr(k−1) is greater than the current voltage command Vr(k) and the next voltage command Vr(k+1) is greater than the current voltage command Vr(k) (S370).

Next, at the step S400, if the increase or decrease in the voltage command of the solar cell is continued the number (n) of predetermined reference times or more, the voltage command is decided by changing the direction of the increase or decrease in the voltage command temporarily determined at the step S200.

Specifically, the step S400 may comprises comparing the voltage command counter Vr_cnt with the number (n) of the predetermined reference times (S410); deciding the next voltage command Vr(k+1) as a value obtained by decreasing the current voltage command Vr(k), when the voltage command counter Vr_cnt is greater than the number (n) of the predetermined reference times and the next voltage command Vr(k+1) is greater than the current voltage command Vr(k) (S440); deciding the next voltage command Vr(k+1) as a value obtained by increasing the current voltage command Vr(k), when the voltage command counter Vr_cnt is greater than the number (n) of the predetermined reference times and the current voltage command Vr(k) is greater than the next voltage command Vr(k+1) (S430); and deciding the temporarily determined next voltage command Vr(k+1), when the number (n) of the predetermined reference times is greater than the voltage command counter Vr_cnt.

At the step S440, the twice of a fluctuation coefficient C may be subtracted from the temporarily determined next voltage command Vr(k+1) so as to convert the next voltage command Vr(k+1) temporarily determined as the increased value into a decreased value. At the step S430, the twice of the fluctuation coefficient C may be added to the temporarily determined next voltage command Vr(k+1) so as to convert the next voltage command Vr(k+1) temporarily determined as the decreased value into an increased value.

At the step S500, the next voltage command Vr(k+1) decided at the step S400 is returned, an inverter (or converter) of the photovoltaic generation system controls the photovoltaic generation using the next voltage command Vr(k+1).

FIG. 3 is a flowchart illustrating an MPPT method according to an embodiment of the present invention so that processes proposed in the present invention are clearly distinguished from general P&O MPPT processes. If the processes shown in FIG. 3 are implemented as they are, the same process is repeatedly performed several times. However, actually, the same step is first performed only once, and the steps determined according to the previously performed result are then performed. Specifically, the determined result at the step S310 is a result previously determined according to which one of the steps S260 to S290 has been performed. At the step S420, the process performed at the step S320 or S330 is again performed.

Figure 4:
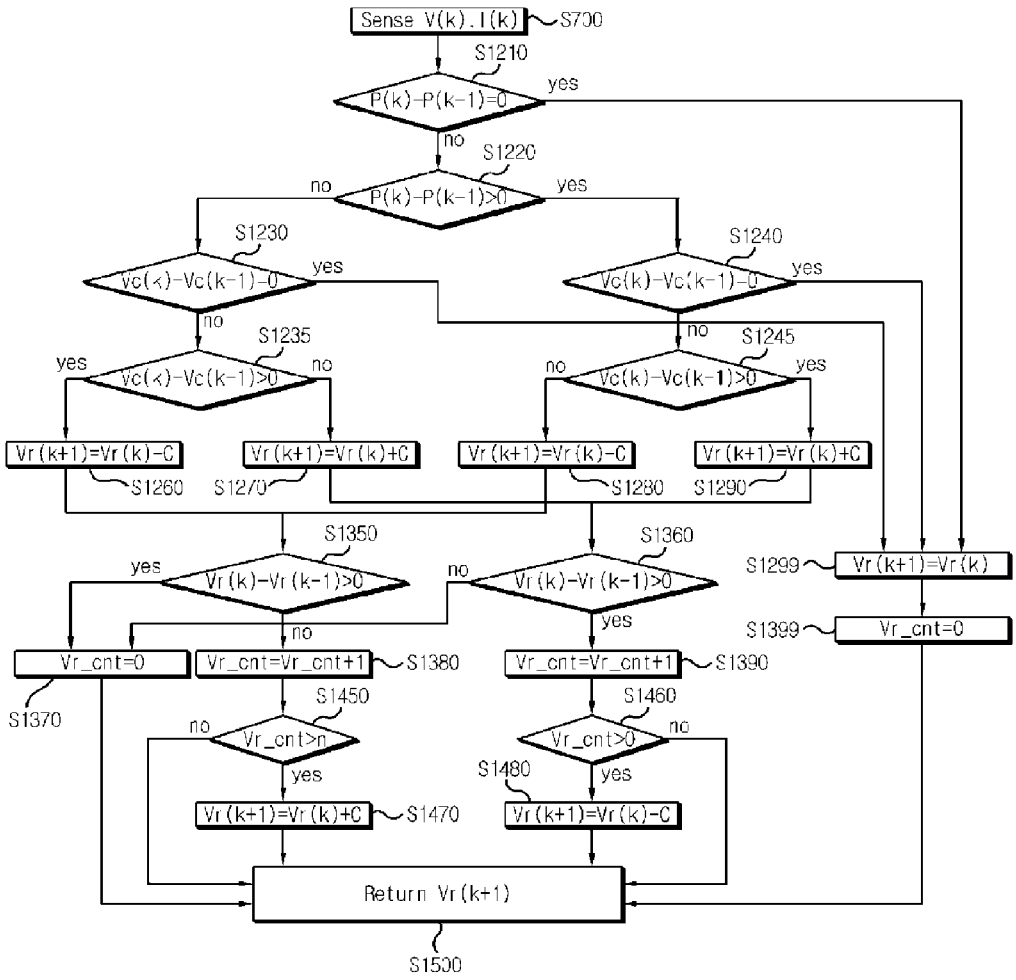
FIG. 4 is a flowchart illustrating an MPPT method according to another embodiment of the present invention.

FIG. 4 is a flowchart illustrating the MPPT method expressed so that overlapping steps of FIG. 3 are not repeatedly performed. In FIG. 4, the MPPT method further includes steps S1230, S1240 and S1299 of deciding a previous voltage command as a next voltage command when current voltage and previous voltage are within the same range.

Figure 5:
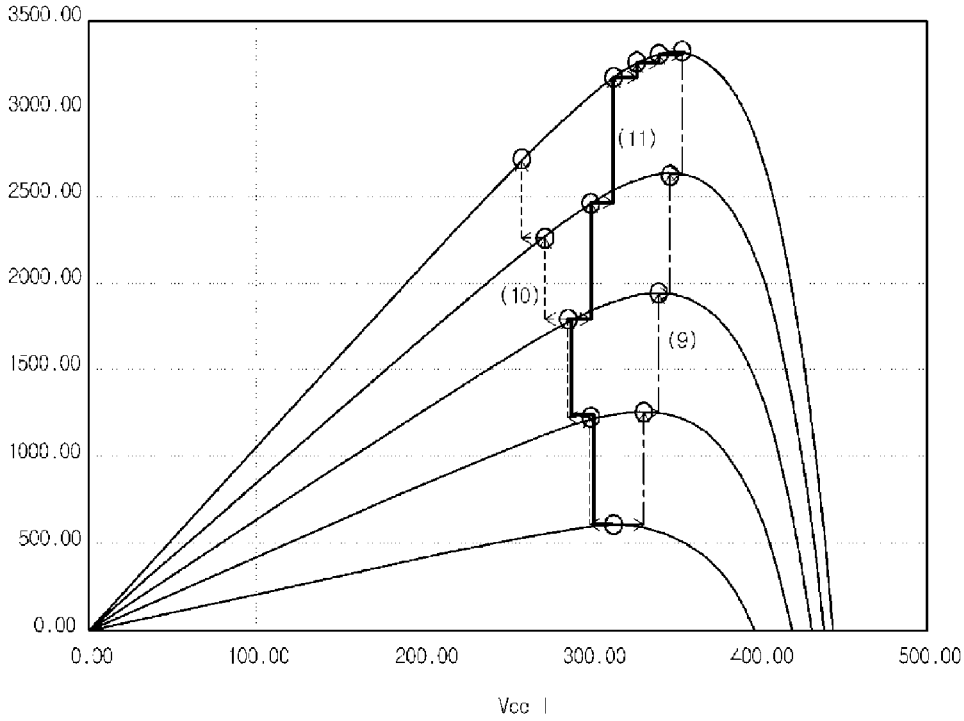
FIG. 5 is a graph illustrating an MPPT principle in an abnormal situation using the MPPT method according to the embodiment of the present invention.

FIG. 5 schematically illustrates an MPPT path 9 in a normal situation, an MPPT path 10 in an abnormal situation and an MPPT path 11 according to the embodiment of the present invention.

If the amount of solar radiation is rapidly increased under the situation where the solar cell operates at a maximum power point in the state that the amount of solar radiation is low, the characteristic curve of the solar cell is gradually increased. In a normal case (in a case where the current voltage command of the solar cell is increased), the maximum power point is tracked as shown in FIG. 5 (line 9).

However, in a case where the amount of solar radiation is rapidly increased under the situation where the current voltage command Vr(k) of the solar cell is decreased, the power is increased even though the voltage of the solar cell is decreased. Therefore, according to the algorithm of FIG. 1, the next voltage command Vr(k+1) of the solar cell is decreased, and the power is also increased in the next MPPT process. Accordingly, the voltage command of the solar cell is continuously decreased, and therefore, the maximum power point is gradually distant from the substantial maximum power point (line 10). When considering only the P&O MPPT technique, this is a normal operation, but substantially becomes a false operation. Therefore, it takes much time to reach the maximum power point.

The MPPT method according to the embodiment of the present invention is a method in which when the voltage command of the solar cell is continued in a certain direction even in an abnormal situation such as line 10, the maximum power point is rapidly tracked to the substantial maximum power point by changing the direction of the voltage command of the solar cell into the opposite direction (line 11).

Figure 6:
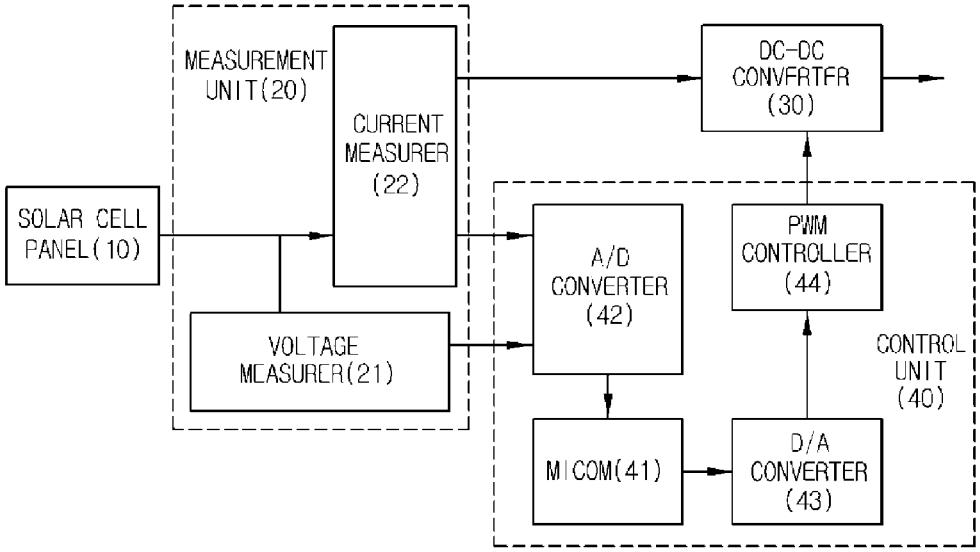
FIG. 6 is a block diagram illustrating a solar cell system for performing the MPPT method according to the present invention.

As shown in FIG. 6, a solar cell system according to the present invention includes a solar cell panel 10, a measurement unit 20, a DC-DC converter 30, and a control unit 40 configured to include a pulse width modulation (PWM) controller 44, a D/A converter 43 and a microcomputer (MICOM, 41). In the solar cell system, the maximum power point of the solar cell panel 10 is tracked, the tracked maximum power point is rectified by the DC-DC converter 30, and the rectified maximum power point is applied to a load (not shown).

The load may be a charging battery of a satellite, electric heater system, electric motor, a commercial AC system or combination thereof.

The solar cell panel 10 may be configured with solar cells including a semiconductor such as amorphous silicon, non-crystalline silicon or single-crystalline silicon, and a compound semiconductor, etc. Generally, a plurality of solar are combined in a series/parallel form and arranged in an array or string form so as to obtain predetermined voltage and current.

The measurement unit 20 is used to measure the voltage and current of the solar cell panel 10, and includes a voltage measurer 21 and a current measurer 22. Here, the voltage measurer 21 may be configured to include a voltage divider using two resistors, and the current measurer 22 may be configured to include a measurement resistor having low resistance, an operation amplifier and a bipolar junction transistor (BJT).

If the maximum voltage supplied from the solar cell panel 10 is about 24.5V, the output of the voltage measurer 21 is preferably limited to 5V or less. Therefore, the resistance ratio of the resistors R1 and R2 of the voltage measurer 21 is configured as 1:4.

The outputs of the voltage and current measurers 21 and 22 are connected to analog input pins (AIN.D and AIN.C) of an ND converter 42, respectively. The A/D converter 42 converts an analog input into a digital input under the control of the MICOM 41, and has an I-wire interface.

The DC-DC converter 30 is used to convert DC power of the solar cell panel 10 and to supply the converted power to the load. The DC-DC converter 30 is configured to include a self-erasing type switching device, and the power flow, input/output voltage and output frequency of the DC-DC converter 30 may be controlled by regulating the duty ratio of a gate pulse or on/off speed. The DC-DC converter 30 has various types, but the buck topology as a voltage falling type is preferably applied to the DC-DC converter 30, in consideration of the charging voltage of the battery of the satellite and the voltage at the maximum power point of the solar cell panel.

A general DC-DC converter is used to convert input power in a certain range into fixed output power. However, in the present invention, the DC-DC converter 30 is used to control input power supplied to the solar cell panel. In the DC-DC converter 30, if the duty ratio of a PWM signal is increased, short-circuit time is increased, and therefore, output current is increased. If the duty ratio of the PWM signal is decreased, the short-circuit time is decreased, and therefore, the output current is decreased. Since P=VI, the voltage is decreased as the output current is increased, and the voltage is increased as the output current is decreased.

Thus, if the output voltage of the solar cell panel 10 is higher than the voltage at the maximum power point, the MICOM 41 increases the duty ratio of the PWM signal. Therefore, the short-circuit time in the DC-DC converter 30 is increased. Accordingly, the output current supplied from the solar cell panel 10 to the load is increased, and the output voltage of the solar cell panel 10 is decreased. On the other hand, if the output voltage of the solar cell panel 10 is lower than the voltage at the maximum power point, the MICOM 41 decreases the duty ratio of the PWM signal. Therefore, the short-circuit time in the DC-DC converter 30 is decreased, and the output current supplied from the solar cell panel 10 to the load is decreased. Accordingly, the output voltage of the solar cell panel 10 is increased.

In order to perform the MPPT method for power generated in the solar cell panel 10, the control unit 40 temporarily determines a next voltage command using voltage and power measured at current and previous time points. If an increase or decrease in voltage command is continued predetermined times or more, the control unit 40 decides that the next voltage command temporarily determined to be increased is decreased or decides that the next voltage command temporarily determined to be decreased is increased. Then, the control unit regulates the output voltage of the solar cell panel 10 based on the decided next voltage command.

Although the present invention has been explained by the embodiments shown in the drawings described above, it should be understood to the ordinary skilled person in the art that the present invention is not limited to the embodiments but rather that various changes or modifications thereof are possible without departing from the spirit of the present invention. Accordingly, the scope of the present invention shall be determined only by the appended claims and their equivalents.

The invention claimed is:

1. A maximum power point tracking (MPPT) method, comprising:

temporarily determining a next voltage command using voltage and power measured at a current time point and a previous time point;

identifying a voltage command counter as a number of times that an increase or decrease of a voltage command is continued after temporarily determining the next voltage command;

deciding that the next voltage command temporarily determined to be increased is decreased or that the next voltage command temporarily determined to be decreased is increased when the voltage command counter is greater than a predetermined number; and regulating an output voltage of a solar cell based on the decided next voltage command;

wherein identifying the voltage command counter comprises:

increasing the voltage command counter when a current voltage command is greater than a previous voltage command and the next voltage command is greater than the current voltage command;

resetting the voltage command counter when the current voltage command is greater than the previous voltage command and the current voltage command is greater than the next voltage command;

increasing the voltage command counter when the previous voltage command is greater than the current voltage command and the current voltage command is greater than the next voltage command; and resetting the voltage command counter when the previous voltage command is greater than the current voltage command and the next voltage command is greater than the current voltage command.

2. The MPPT method of claim 1, wherein the decided next voltage command is obtained by:

decreasing the current voltage command when the voltage command counter is greater than the predetermined number and the next voltage command is greater than the current voltage command;

increasing the current voltage command when the voltage command counter is greater than the predetermined number and the current voltage command is greater than the next voltage command; and deciding the temporarily determined next voltage command as the decided next voltage command when the predetermined number is greater than the voltage command counter.

3. A maximum power point tracking (MPPT) method, comprising:

temporarily determining a next voltage command using voltage and power measured at a current time point and a previous time point;

deciding that the next voltage command temporarily determined to be increased is decreased or that the next voltage command temporarily determined to be decreased is increased when an increase or decrease in a voltage command is continued for more than a predetermined number of times; and regulating an output voltage of a solar cell based on the decided next voltage command, wherein temporarily determining the next voltage command comprises:

increasing a previous voltage command when a current power is greater than a previous power and a current voltage is greater than a previous voltage;

decreasing the previous voltage command when the current power is greater than the previous power and the previous voltage is greater than the current voltage;

decreasing the previous voltage command when the previous power is greater than the current power and the current voltage is greater than the previous voltage; and increasing the previous voltage command when the previous power is greater than the current power and the previous voltage is greater than the current voltage.

4. The MPPT method of claim 3, further comprising deciding the previous voltage command as the next voltage command when the current power and the previous power are within a same range.

5. The MPPT method of claim 3, further comprising deciding the previous voltage command as the next voltage command when the current voltage and the previous voltage are within a same range.

* * * * *